US012352034B2

(12) United States Patent
Pospisil et al.

(10) Patent No.: US 12,352,034 B2
(45) Date of Patent: Jul. 8, 2025

(54) LOAD BEARING WALL CONSTRUCTION SYSTEM USING HOLLOW STRUCTURAL SECTIONS

(71) Applicant: UNITED STATES GYPSUM COMPANY, Chicago, IL (US)

(72) Inventors: Frank Pospisil, Oak Park, IL (US); Kyle Flondor, Chicago, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 178 days.

(21) Appl. No.: 17/823,363

(22) Filed: Aug. 30, 2022

(65) Prior Publication Data

US 2023/0272612 A1 Aug. 31, 2023

Related U.S. Application Data

(60) Provisional application No. 63/313,954, filed on Feb. 25, 2022.

(51) Int. Cl.
*E04B 1/24* (2006.01)
*E04B 1/343* (2006.01)

(52) U.S. Cl.
CPC ..... *E04B 1/34321* (2013.01); *E04B 1/24* (2013.01); *E04B 2001/2481* (2013.01)

(58) Field of Classification Search
CPC .. E04B 1/3483; E04B 1/24; E04B 2001/2481; E04B 2/58; E04B 2001/2472; E04B 1/34321; E04H 1/005; E04H 2001/1283
See application file for complete search history.

(56) References Cited

U.S. PATENT DOCUMENTS

| | | | |
|---|---|---|---|
| 2,457,982 | A | 1/1949 | Deichmann |
| 6,014,843 | A | 1/2000 | Crumley et al. |
| 6,112,473 | A | 9/2000 | Pingel |
| 6,164,035 | A | 12/2000 | Roberts |
| 6,185,898 | B1 | 2/2001 | Pratt |

(Continued)

FOREIGN PATENT DOCUMENTS

SU 1652475 A1 5/1991

OTHER PUBLICATIONS

International Search Report and Written Opinion received for PCT/US2023/062903, mailed Jun. 16, 2023.

*Primary Examiner* — Brian E Glessner
*Assistant Examiner* — Daniel J Kenny
(74) *Attorney, Agent, or Firm* — Greer, Burns & Crain, Ltd; Philip T. Petti; Pradip Sahu

(57) ABSTRACT

A construction unit is provided, including a load-bearing frame including a plurality of upper horizontal members joined together at ends to form an upper frame portion, a plurality of lower horizontal members joined together at ends to form a lower frame portion, a plurality of vertical members joined to and vertically separating the upper frame portion from the lower frame portion, the vertical members being located at opposing corners defined by the upper frame portion and the lower frame portion. At least one hollow structural section is vertically positioned between the upper and lower frame portions and is fixed to the frame between adjacent pairs of the vertical members; and at least one sheathing panel joined directly to the at least one hollow structural section for forming a wall of the construction unit.

14 Claims, 9 Drawing Sheets

(56) References Cited

U.S. PATENT DOCUMENTS

| | | | | |
|---|---|---|---|---|
| 6,562,444 | B1 * | 5/2003 | Gleeson | C04B 28/02 428/312.2 |
| 6,986,812 | B2 | 1/2006 | Dubey et al. | |
| 7,445,738 | B2 | 11/2008 | Dubey et al. | |
| 7,467,469 | B2 * | 12/2008 | Wall | E04B 1/34336 29/897 |
| 7,670,520 | B2 | 3/2010 | Dubey | |
| 7,789,645 | B2 | 9/2010 | Dubey et al. | |
| 8,030,377 | B2 | 10/2011 | Dubey et al. | |
| 8,850,764 | B2 * | 10/2014 | Zimmerman | F16B 9/058 52/92.2 |
| 10,066,390 | B2 * | 9/2018 | Pospisil | E04B 1/94 |
| 10,508,442 | B2 * | 12/2019 | Collins | E04B 5/02 |
| 11,193,271 | B2 * | 12/2021 | Simonic | E04B 2/7411 |
| 11,352,787 | B2 * | 6/2022 | Amend | E04B 2/8647 |
| 11,384,524 | B2 * | 7/2022 | Pospisil | E02D 27/00 |
| 2007/0294974 | A1 * | 12/2007 | Tonyan | B28C 5/365 428/70 |
| 2008/0134589 | A1 * | 6/2008 | Abrams | E04B 1/34807 52/79.1 |
| 2010/0115867 | A1 | 5/2010 | Bui | |
| 2010/0269442 | A1 * | 10/2010 | Black | E04C 2/384 52/794.1 |
| 2011/0173907 | A1 * | 7/2011 | Katsalidis | E04C 3/30 52/741.1 |
| 2016/0025461 | A1 * | 1/2016 | Roberts | F41H 5/24 228/101 |
| 2020/0141109 | A1 | 5/2020 | Pospisil et al. | |
| 2020/0340231 | A1 | 10/2020 | Baughey | |
| 2023/0145279 | A1 * | 5/2023 | Snorrason | E04B 1/34861 52/79.1 |

* cited by examiner

LOAD BEARING WALL CONSTRUCTION SYSTEM USING HOLLOW STRUCTURAL SECTIONS

RELATED APPLICATION

This application is a Non-Provisional of, and claims 35 USC 119 priority from, U.S. Provisional application Ser. No. 63/313,954 filed Feb. 25, 2022, the contents of which are incorporated by reference herein.

BACKGROUND

The present application relates generally to the construction of multi-story residential and commercial buildings incorporating walls supported by vertically disposed steel studs, in a preferred embodiment to such buildings constructed using modular construction units, and more specifically to an improved construction system for such structures that enhances fire resistance.

It is a growing trend to construct multi-story residential and/or commercial buildings, including hotels, apartments, dormitories, classrooms, restaurants and the like using modular units, especially in crowded urban areas where heavy construction equipment has difficulty maneuvering. Modular construction reduces material waste, and since the units are assembled indoors at remote locations, labor costs and working conditions are more closely controlled. Such modular units are remotely constructed and assembled, trucked to the building site, then placed in position using a crane. Many modular units are as long as 75 feet and are assembled by stacking vertically, side-by-side, end-to-end, thus providing a variety of configurations of the final building design.

Each modular unit has a steel frame including beams and joists, and depending on the application represents one or more apartment units. Walls are conventionally assembled with studs and panels, and windows are installed in the stud frames in a conventional manner. Examples of suitable modular construction units are disclosed in U.S. Pat. No. 10,066,390 which is incorporated by reference. Also, the use of modular construction in below ground applications is disclosed in US Patent Publication No. 2020/0141109, also incorporated by reference.

Conventional modular construction involves the creation of a basic modular frame of sturdy, load bearing construction. Each modular unit should be sufficiently strong to support the weight of the modules above when stacked vertically to form a multi-story building. In addition to sturdy steel vertical frame members at each corner of the modular unit, it is customary to employ Hollow Structural Sections (HSS) at least mid-span of the frame to provide enhanced load-bearing capability to the modular frame. HSS members are preferably made of heavy gauge steel in the range of ⅛" to ¾" (0.3175-1.90 cm) thick, but different thicknesses are possible and are preferably welded to the modular frame.

Once the modular frame is constructed, non load-bearing walls are conventionally added using cold formed steel "C"-studs fastened to horizontally-positioned footer and header members as is well known in the art. "C"-studs have generally replaced wooden 2'×4' studs in commercial construction due to evolving municipal building codes, and the "C"-studs have similar dimensions to the wooden parts they replace. Wallboard or other suitable sheathing panels are then secured to the "C"-studs using threaded fasteners.

Current building fire codes for modular units rate the unit based on the fire retarding capabilities of the combination of the metal "C"-studs and the wallboard panels. When the modular frame includes HSS members, needed for load bearing requirements, such members are not included in the evaluation of the fire retardant properties of the modular unit. As such, as the modular units are constructed, the assemblers fabricating walls of modular units typically have to "build around" the HSS members, which adds to the time and labor involved in constructing a typical module.

Accordingly, there is a need for an improved modular unit construction which addresses the design, inconvenience and expense of the conventional modular unit construction.

SUMMARY

The above-listed need is met or exceeded by the present construction system, preferably but not exclusively related to modular construction, which includes a modular construction unit or module with a load bearing steel frame equipped with vertically positioned HSS members located between corner frame supports. The HSS members are dimensioned to correspond to the dimensions of conventional "C"-stud, particularly their depths, and as such are positioned to form walls in the modular construction unit. Gypsum wallboard or other sheathing panels are attached directly to the HSS members. In embodiments, HSS members are disposed as all of the vertical wall supports in a modular unit, or are interspaced with conventional "C"-studs. Spacing of the HSS members relative to the "C"-studs along the span of the modular load bearing frame varies with the application, and patterns of HSS-C-HSS-C are contemplated, as are HSS-C-C-HSS-C-C-HSS, with each HSS member or "C"-stud located on up to 24-inch spacing on center. The present system is useful in any construction environment where framing is assembled using "C"-studs and HSS members.

By employing the HSS members in the construction of the walls of the present, preferably modular construction unit, so that the sheathing panels are directly attached to the HSS members, the desired fire rating of 1, 2 or 3 hours is achieved. A 1-hour fire rating is achieved using a single thickness of sheathing panel, preferably gypsum wallboard, but also contemplated as structural cement panel. A 2-hour fire rating is achieved using a double thickness of preferably gypsum wallboard sheathing panels. A 3-hour fire rating is achieved using a double panel thickness, where one of the panels is structural cement board, and the other panel is gypsum wallboard. Other configurations and combinations of sheathing are possible for similar fire ratings.

More specifically, a construction unit is provided, including a load-bearing frame including a plurality of upper horizontal members joined together at ends to form an upper frame portion, a plurality of lower horizontal members joined together at ends to form a lower frame portion, a plurality of vertical members joined to and vertically separating the upper frame portion from the lower frame portion, the vertical members being located at opposing corners defined by the upper frame portion and the lower frame portion. At least one hollow structural section is vertically positioned between the upper and lower frame portions and is fixed to the frame between adjacent pairs of the vertical members; and at least one sheathing panel is joined directly to the at least one hollow structural section for forming a wall of the construction unit.

In an embodiment, a first plurality of the at least one sheathing panel directly secured to the at least one hollow structural section forms at least one external wall of the construction unit, and a second plurality of the at least one sheathing panel forms at least one internal wall of the construction unit.

In an embodiment, at least one sheathing panel is made of one of gypsum wallboard and structural cement board. Also, in another embodiment the at least one sheathing panel is provided in a double thickness, with two panels joined together and attached to the at least one hollow structural section. Preferably, one of the panels joined together is gypsum wallboard, and the other is structural cement panel.

In an embodiment, the at least one hollow structural section is a plurality of horizontally spaced hollow structural sections secured to the load bearing frame between the adjacent pairs of vertical members. In one embodiment, at least one "C"-stud is secured to the load bearing frame adjacent to the at least one hollow structural section so that the at least one sheathing panel is secured directly to both the at least one hollow structural section and to the at least one "C"-stud. In an embodiment, included is a first plurality of the at least one hollow structural sections, and a second plurality of the at least one "C"-studs secured to the load bearing frame between adjacent pairs of the vertical members in an alternating arrangement.

In another embodiment, included is a first plurality of the at least one hollow structural sections, and a second plurality of the at least one "C"-studs secured to the load bearing frame in a pattern such that between each pair of the hollow structural sections is a pair of the "C"-studs.

In another embodiment, a modular construction unit is provided, including a load-bearing frame including a plurality of upper horizontal members joined together at ends to form an upper frame portion, a plurality of lower horizontal members joined together at ends to form a lower frame portion, a plurality of vertical members joined to and vertically separating the upper frame portion from the lower frame portion, the vertical members being located at opposing corners defined by the upper frame portion and the lower frame portion. At least one hollow structural section is vertically positioned between the upper and lower frame portions and is fixed to the frame between adjacent pairs of the vertical members. At least one sheathing panel is joined directly to the at least one hollow structural section for forming a wall of the modular construction unit. Each sheathing panel is provided in a double thickness, with two panels joined together and attached to the at least one hollow structural section, one of the panels joined together is gypsum wallboard, and the other is structural cement panel.

At least one "C"-stud is secured to the load bearing frame adjacent to the at least one hollow structural section so that the at least one sheathing panel is secured directly to both the at least one hollow structural section and to the at least one "C"-stud.

In still another embodiment, a multi-story building is provided, including an assembly of vertically stacked modular construction units, each modular construction unit includes a load-bearing frame including a plurality of upper horizontal members joined together at ends to form an upper frame portion, a plurality of lower horizontal members joined together at ends to form a lower frame portion, a plurality of vertical members joined to and vertically separating the upper frame portion from the lower frame portion, the vertical members being located at opposing corners defined by the upper frame portion and the lower frame portion. At least one hollow structural section is vertically positioned between the upper and lower frame portions and is fixed to the frame between adjacent pairs of the vertical members, and at least one sheathing panel is joined directly to the at least one hollow structural section for forming a wall of the modular construction unit.

Selected members of the assembly of the modular construction units have at least one "C"-stud secured to the load bearing frame adjacent to the at least one hollow structural section so that the at least one sheathing panel is secured directly to both the at least one hollow structural section and to said at least one "C"-stud, and an arrangement of the at least one hollow structural section and the at least one "C"-stud varying in the modular construction units in the assembly such that the amount of the at least one "C"-stud increases relative to the at least one hollow structural section in each modular construction unit as the respective modular construction unit is placed higher in elevation in the building.

DETAILED DESCRIPTION

Figure 1:
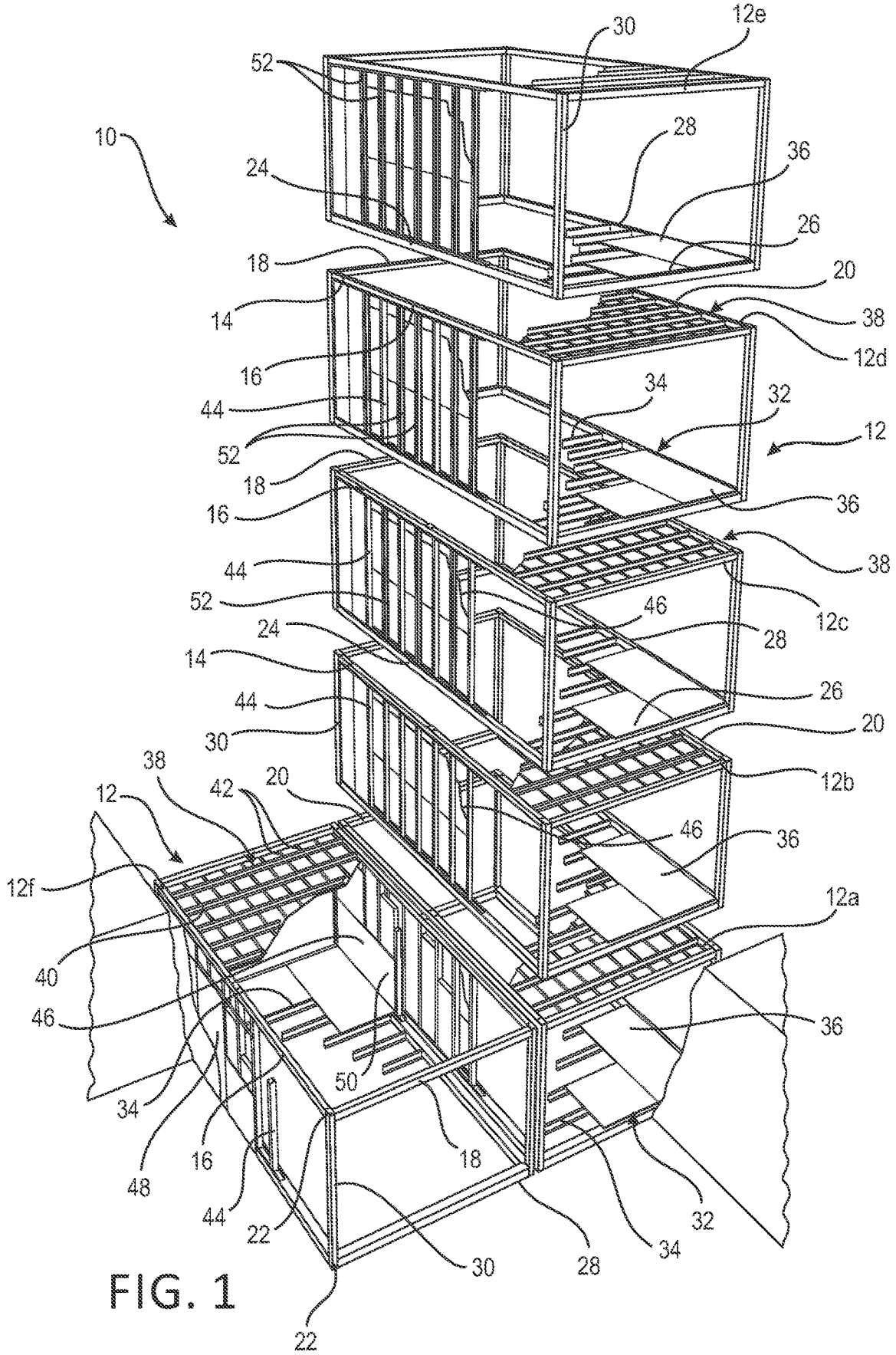
FIG. 1 is a fragmentary exploded perspective view of a multi-story building made of stacked modular units featuring the present construction system.

Referring now to FIGS. 1-5, a multi-story building is generally designated 10, and is constructed of a plurality of modular construction units, generally designated 12, for the most part stacked vertically and designated from a foundation or basement unit 12*a* to a first story unit 12*b*, a second story unit 12*c*, a third story unit 12*d* and a fourth story unit 12*e*. A second, laterally-spaced foundation or basement unit is designated 12*f*. As seen, both foundation units 12*a* and 12*f* are located primarily below grade. It is contemplated that such units 12*a*, 12*f* are optionally supplemented with or placed upon further foundation levels at corresponding greater depths or sub basements, which varies per the application. Also, depending on the application, the building 10 may have additional stories of modular construction units 12 above the modular construction unit 12*e*.

While preferably focused on modular construction units, the present construction system is contemplated for use with any construction environment using metal framing elements as described below. Each of the modular construction units 12*a*-12*f* has a load-bearing frame 14 made of high strength steel, preferably at least 20 gauge steel, including a plurality of upper horizontal members 16 and 18 joined together at ends to form an upper frame portion 20. Ends of the joined members 16, 18 are formed as corners 22 at preferably 90° angles. Also included in the load bearing frame 14 is a plurality of lower horizontal members 24 and 26 joined together at ends to form a lower frame portion 28. As is the case with the upper frame portion 20, in the lower frame portion 28 joined ends of the members form corners 22, preferably at 90° angles. A plurality of vertical members 30 are joined to and vertically separating the upper frame portion 20 from the lower frame portion 28, and the vertical members are preferably located at opposing corners 22 defined by the upper and lower frame portions.

Each modular construction unit 12 has a floor 32 formed by a plurality of spaced parallel floor joists 34 joined to the lower frame portion 28, as by welding, rivets or other fastening techniques known in the art. Structural panels 36 are fastened to the joists 34 as is known in the art. Further details of this construction, especially relating to the construction of the floor 32, are described in U.S. Pat. No. 10,066,390 incorporated by reference herein. Opposite the floor 32, a ceiling 38 is formed by a plurality of spaced, parallel ceiling joists 40, preferably lighter gage steel than the floor joists, but also being secured as by welding, rivets or the like to the upper frame portion 20. Resilient Channel members 42 are secured to lower surfaces of the ceiling joists 40 in spaced parallel orientation at right angles to the joists. As is customary, wallboard panels (not shown) are commonly secured to the Resilient Channel members 42.

At least one hollow structural section (HSS) 44 is vertically positioned between the upper and lower frame portions 20, 28 and is fixed to the load bearing frame 14 between adjacent pairs of the vertical members 30. In some applications, header or footer channels 45 are also provided to facilitate such attachment to the frame 14. The present HSS 44 varies from conventional products in having similar depth to conventional "C"-studs. As such, the HSS 44 has a horizontal cross-section with a minimum 3.5 inch (8.89 cm) length and a minimum 1.5 inch (3.81 cm) width, and the thickness of the material is ⅛ inch (0.3175 cm) for 1 and 2—hour fire ratings, and nominal 6 inch (15.24 cm)× minimum 1.5 inch (3.81 cm) with a ⅛ inch (0.3175 cm) thickness for 3-hour fire ratings. Also, the HSS 44 is hollow and made of load bearing steel, preferably in the ⅛" to ¾" (0.3175-1.90 cm) thick range, but different thicknesses are possible. The particular gauge of steel used for the HSS 44 may vary to suit the application.

Each HSS 44 is secured at upper and lower ends to the corresponding upper and lower frame portions 20, 28 as by welding, rivets or other known fastening techniques. A feature of the present modular construction unit 12 is that it is constructed and arranged so that at least one sheathing panel 46 is joined directly to the at least one HSS 44 for forming a wall of the modular construction unit. The sheathing panels 46 are secured to the HSS 44 using threaded fasteners (not shown) as known in the art. Preferably, the fasteners are configured for metal piercing, including among other things, specialized sharpened or self-drilling tips as are known in the art. Also preferred is that the sheathing panels 46 are gypsum wallboard. As is known in the art, gypsum wallboard panels, particularly having a ⅝-inch (1.587 cm) are known for preventing the spread of fire in interior construction, especially when fastened to metal framework, conventionally "C"-studs. However, other known construction panels are contemplated. In a preferred embodiment, a first plurality of panels 46 is provided to form external walls 48 of the modular construction unit 12, and a second plurality of panels 46 is provided to form internal walls 50 of the modular construction unit.

Figure 2:
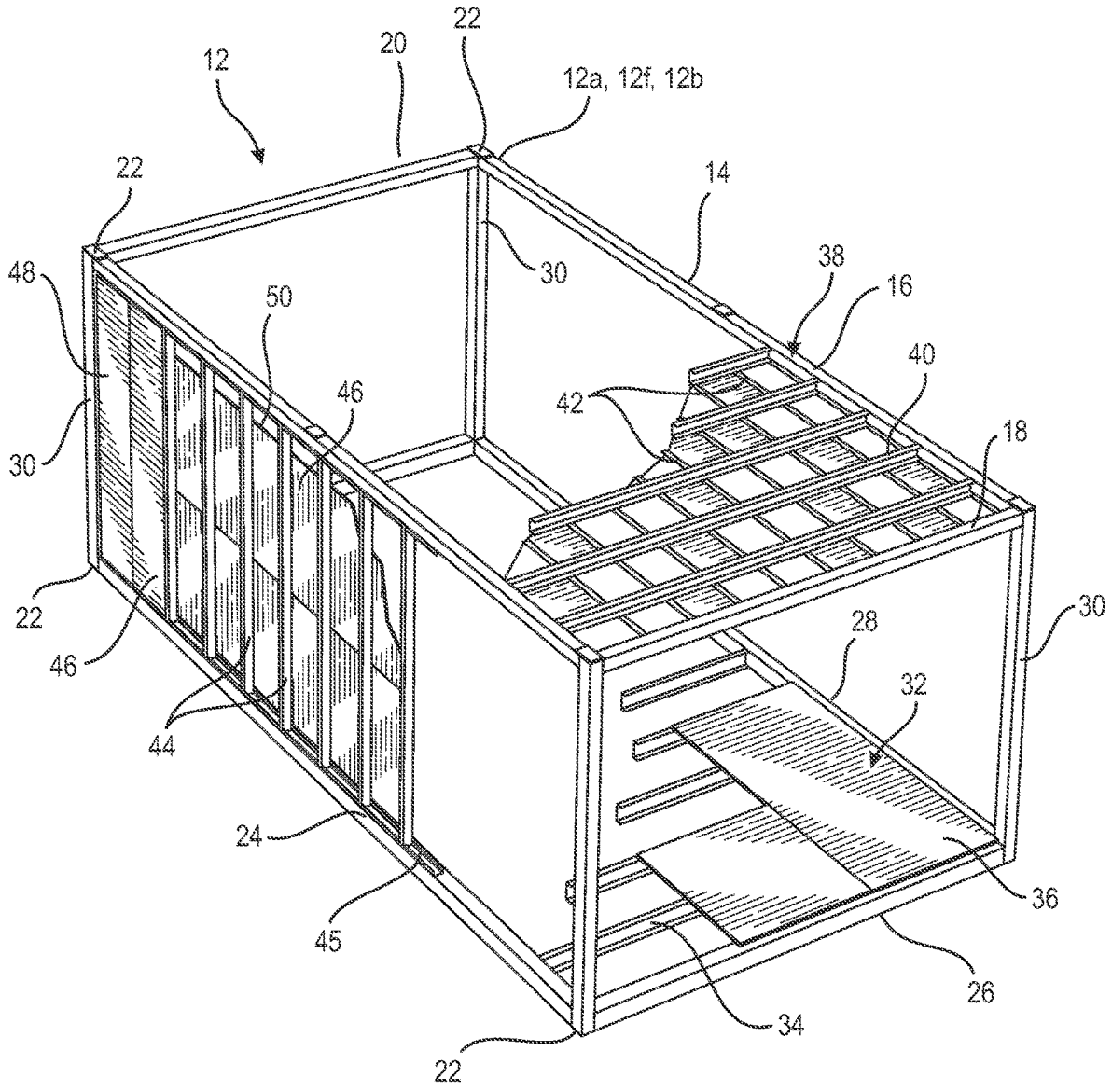
FIG. 2 is an enlarged fragmentary perspective view of one of the modules of the building shown in FIG. 1.

Referring now to FIGS. 1 and 2, it is preferred that the foundation modular construction units 12*a* and 12*f*, as well as the first story modular construction unit 12*b* or other lower story modular units are configured so that HSS 44 are placed in spaced, parallel orientation all along the modular unit between adjacent pairs of the vertical members 30. A preferred horizontal spacing between HSS 44 is 24 inches, however other spacing is contemplated depending on the application. In this configuration, the modular construction units 12*a*, 12*b*, 12*f* have a significant load-bearing capacity. Also, by securing the sheathing panels 46 directly to the HSS 44, the fire rating of the modular construction unit 12 is at least that of conventional modular units, or with a fire rating of at least 1-hour.

Figure 3:
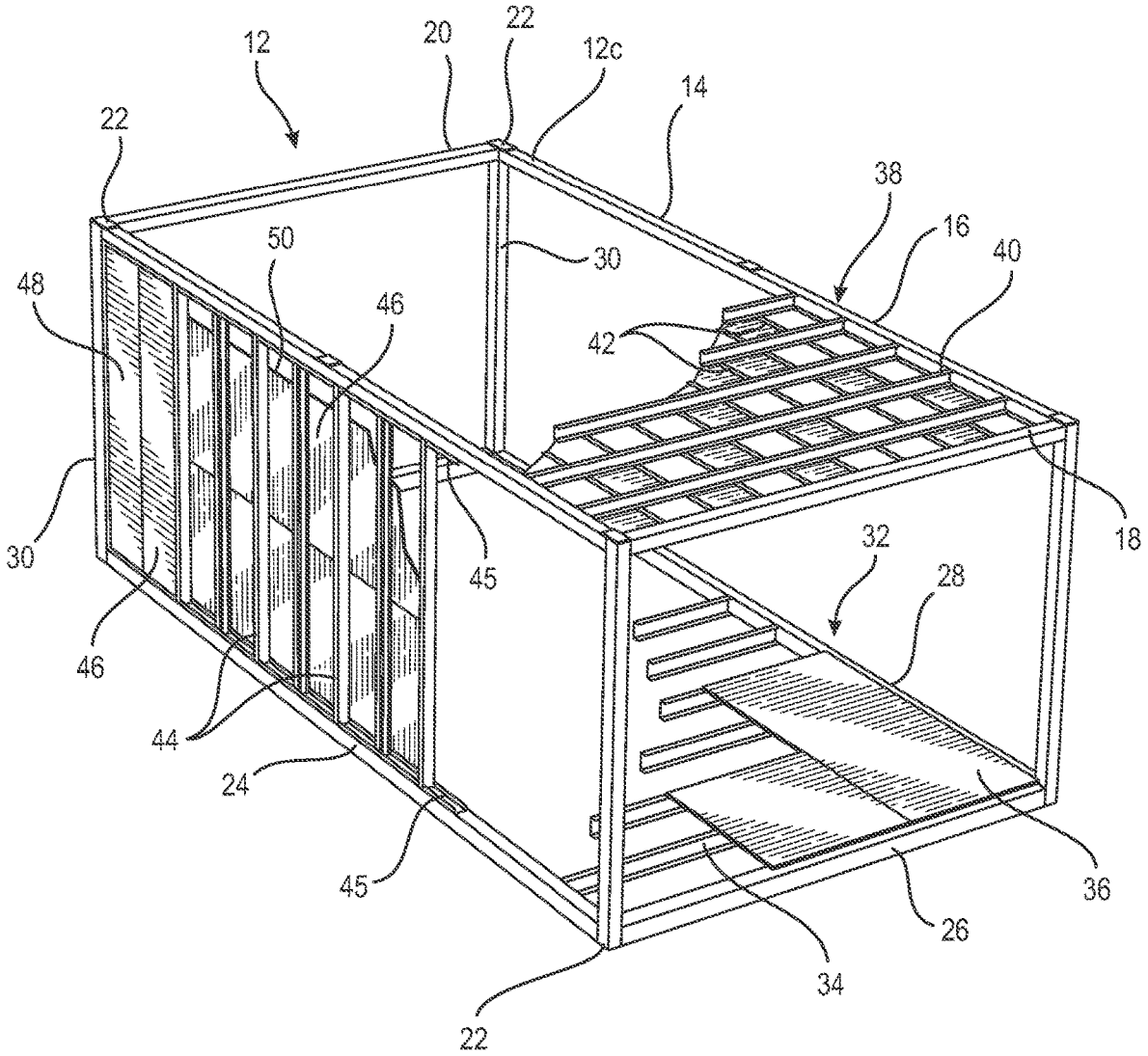
FIG. 3, is an enlarged fragmentary perspective view of another one of the modules of the building shown in FIG. 1.

Referring now to FIGS. 1 and 3, the second story modular construction unit 12*c* is shown and represents a next series of floors in the building, located above a foundation portion 12*a*, 12*f*. Components shared with the other modular construction units 12*a* and 12*b* are designated with identical reference numbers. A main distinctive feature of the modular construction unit 12*c* is that at least one "C"-stud 52 secured to the load bearing frame 14 adjacent to the HSS 44 so that the sheathing panels 46 are secured directly to both the "C"-stud and the HSS. The "C"-stud 52 is made of steel, preferably 20-12 gauge and as is known in the art, has replaced the use of wooden 2×4 studs in commercial construction. Also, the "C"-stud 52 is secured to the load bearing frame 14 through the use of fasteners or welding as known in the art. Header and/or footer channels 45 are also preferably employed to enhance fastening of the "C"-studs 52 to the frame 14. Preferably, similar fasteners are employed to install the sheathing panels 46 regardless of the supporting substrate. A preferred horizontal spacing between HSS 44 and the "C"-studs 52 is 24 inches, however other spacing is contemplated depending on the application. As seen in FIG. 3, the HSS 44 and the "C"-studs 52 are secured the load bearing frame in an alternating arrangement along the span of the modular construction unit 12*c* between the vertical members 30. In other words, the assembled pattern between the vertical members 30 is HSS 44-"C"-stud 52-HSS 44-"C-stud 52, etc.

Figure 4:
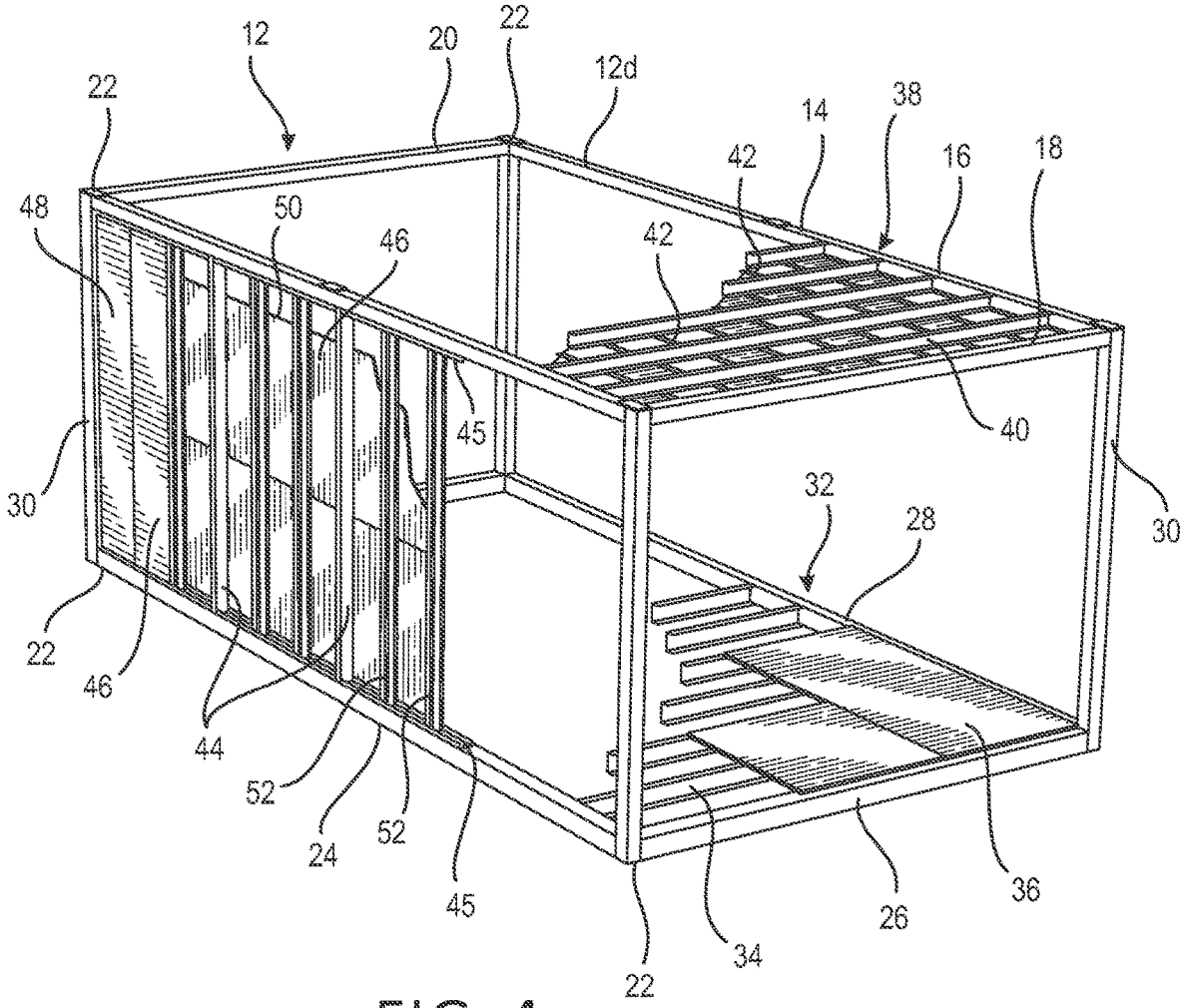
FIG. 4 is an enlarged fragmentary perspective view of yet another one of the modules of the building shown in FIG. 1.

Referring now to FIGS. 1 and 4, the third story modular construction unit 12*d* is shown and represents placement of modular units at a higher elevation than described earlier in relation to units 12*a*, 12*b*, 12*f* and 12*c*. Components shared with the other modular construction units 12*a,* 12*b* and 12*c* are designated with identical reference numbers. A main distinctive feature of the modular construction unit 12*d* is that a first plurality of the HSS 44 is provided, along with a second plurality of the "C"-studs 52 secured to the load bearing frame 14 in a pattern such that between each pair of HSS 44 is a pair of adjacent "C"-studs. In other words, the assembled pattern between the vertical members 30 is HSS 44-"C"-stud 52-"C"-stud 52 HSS 44-"C"-stud 52-"C-stud 52-HSS 44, etc. A preferred horizontal spacing between HSS 44 and the respective "C"-studs 52 is 24 inches, however other spacing is contemplated depending on the application.

Figure 5:
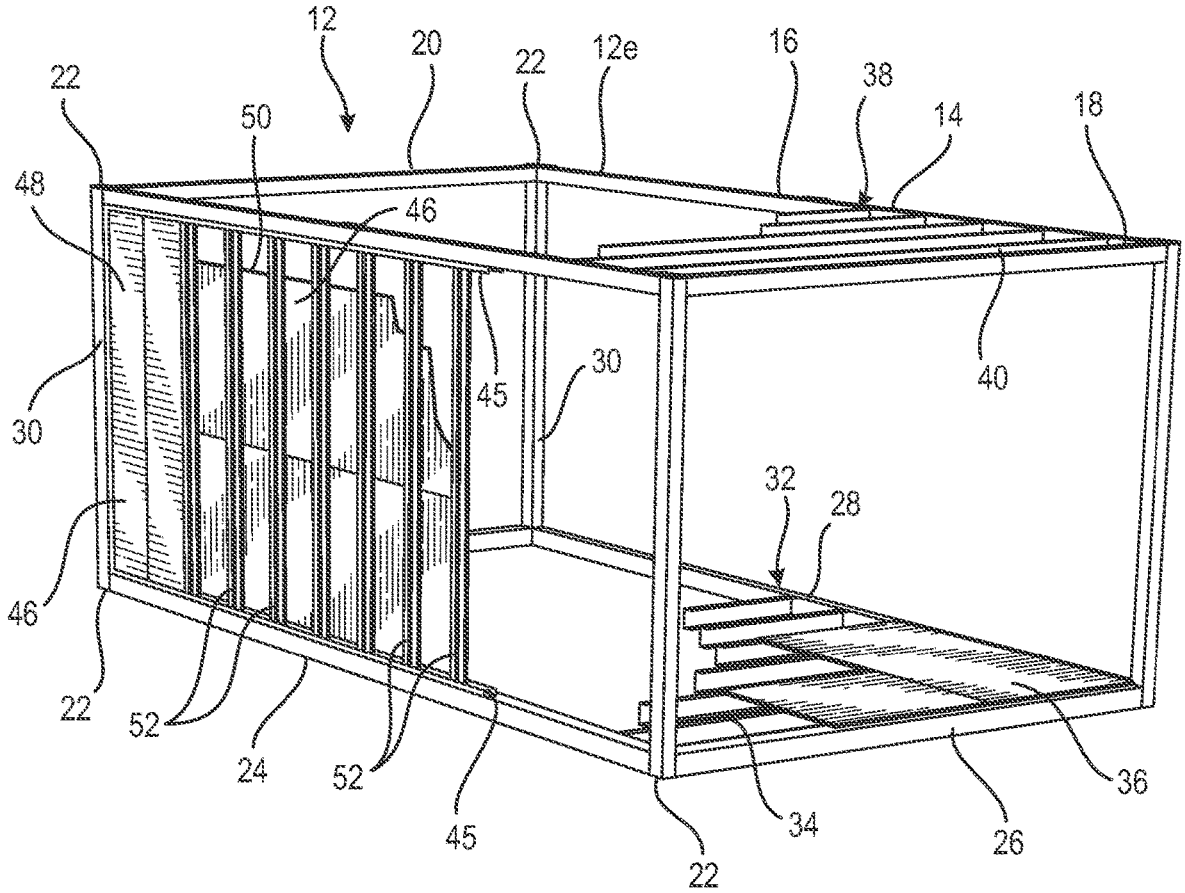
FIG. 5 is an enlarged fragmentary perspective view of still another one of the modules of the building shown in FIG. 1.

Referring now to FIGS. 1 and 5, the fourth story modular construction unit 12*e* is shown. Components shared with the other modular construction units 12*a,* 12*b,* 12*c* and 12*d* are designated with identical reference numbers. A main distinctive feature of the modular construction unit 12*e* is that there are no HSS 44 sections included between the adjacent vertical members 30. Instead, only a plurality of "C"-studs 52 is provided in vertically spaced relationship secured to the load bearing frame 14 between the vertical members 30.

It is noted that between the modular construction units 12*b,* 12*c,* 12*d* and 12*e*, each unit has lower load bearing capacity as it is placed in higher floors of the building 10. As less weight above needs to be supported, the modular construction units 12 can be made lighter, and using progressively less expensive materials. In other words, the building 10 has an arrangement of the HSS 44 and the "C"-studs 52 varying in the modular construction units 12*a*-12*e* as the building is assembled such that the amount of the "C"-studs increases relative to the HSS 44 in each modular construction unit 12 as the respective modular construction unit is placed higher in elevation in the building. It is contemplated that the specific orientation of the respective modular units 12*a-e* may vary to suit the application, and multiple floors of a particular building 10 have a variety of sequences of the respective modular construction units.

Figure 6:
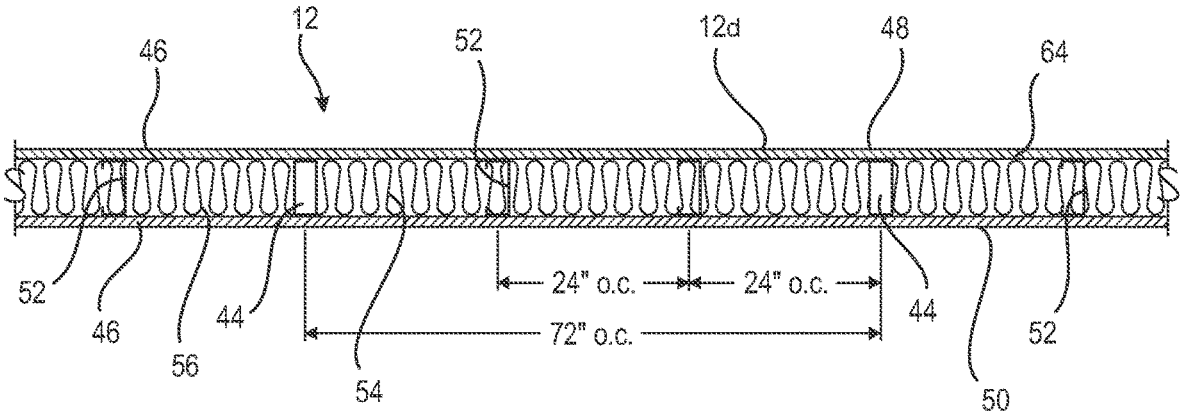
FIG. 6 is a horizontal cross-section of a wall of the modular unit shown in FIG. 4.
Figure 7:
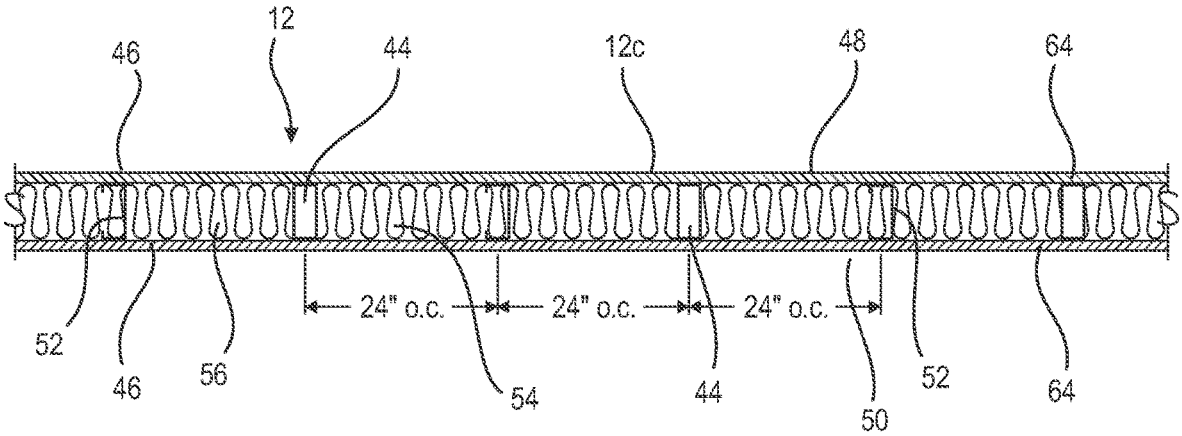
FIG. 7 is a horizontal cross-section of a wall of the modular unit shown in FIG. 3.
Figure 8:
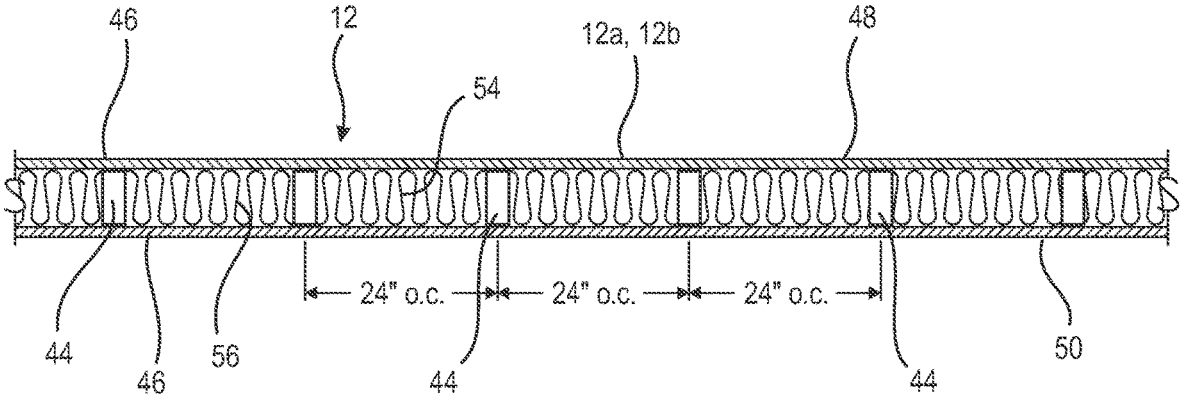
FIG. 8 is a horizontal cross-section of a wall of the modular unit shown in FIG. 2.

Referring now to FIGS. 6-8, horizontal cross-sections are provided, respectively of modular construction units 12*d,* 12*c* and 12*a,b*. The preferred spacing of 24 inches between HSS 44 and "C"-studs 52 depending on the arrangement of components is shown, along with the attachment of sheathing panels 46 forming the external wall 48 and the internal wall 50 of the modular construction unit 12. As needed, bats of insulation 54, such as fiberglass insulation or the like are inserted in cavities 56 formed in the wall between the sheathing panels 46 and the respective HSS 44 and the "C"-studs 52 and the vertical members 30. The assemblies shown in FIGS. 6-8 have a 1-hour fire rating, regardless of whether the HSS 44 or the "C"-studs 52 are provided. For a 3-hour fire rating, the bats of insulation 54 preferably have a nominal density of 0.75 pcf (12.01 kg/m$^3$).

Figure 9:
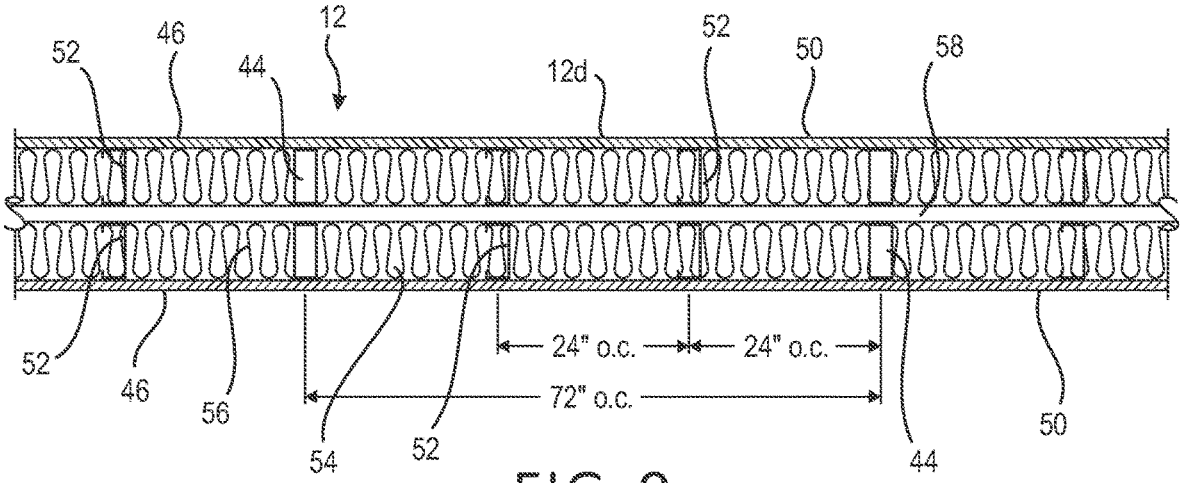
FIG. 9 is a horizontal cross-section of a wall of two adjacent modular units constructed according to the embodiment of FIG. 4.
Figure 10:
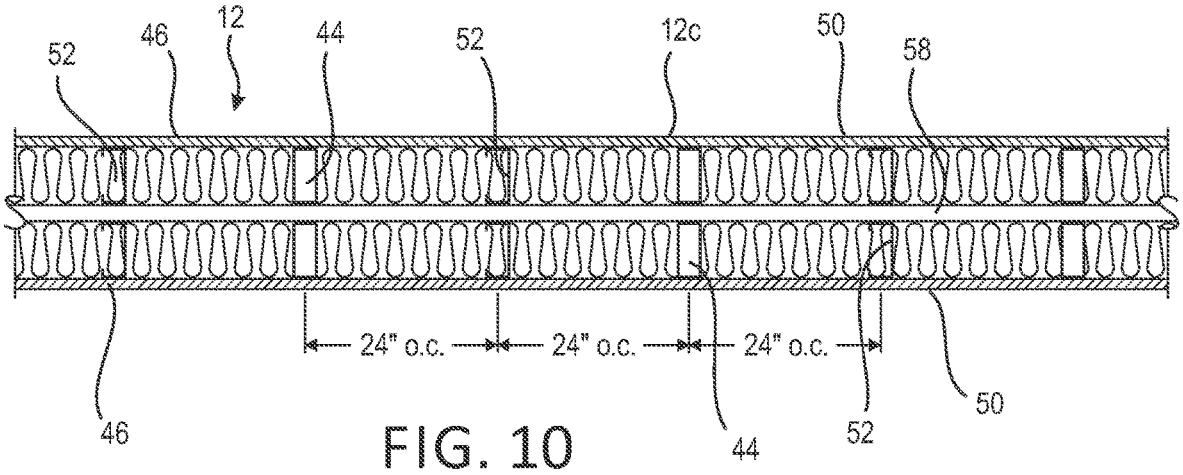
FIG. 10 is a horizontal cross-section of a wall of two adjacent modular units constructed according to the embodiment of FIG. 3.
Figure 11:
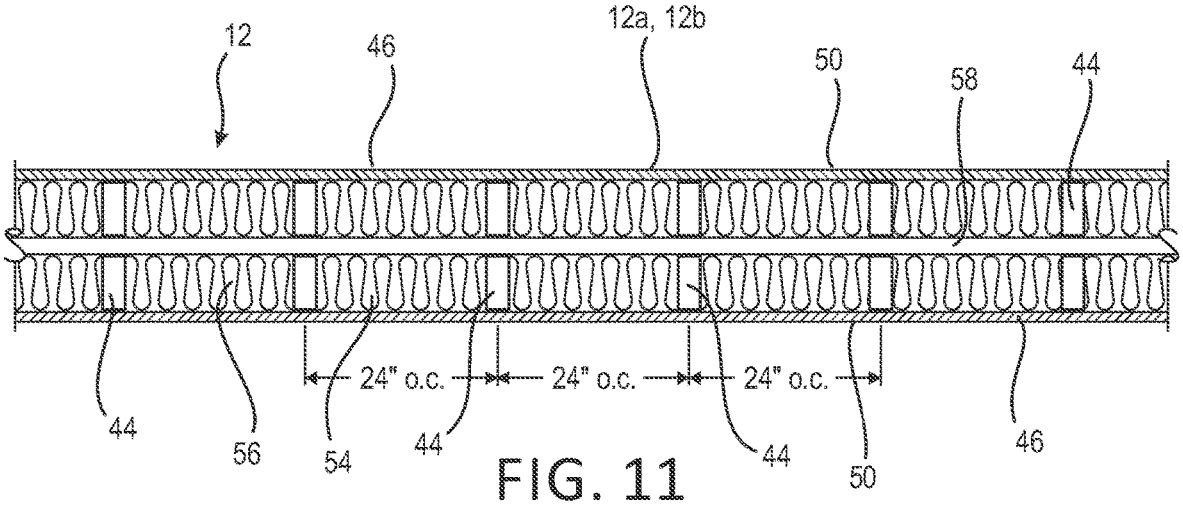
FIG. 11 is a horizontal cross-section of a wall of two adjacent modular units constructed according to the embodiment of FIG. 2.

Referring now to FIGS. 9-11, horizontal cross-sections are provided, respectively of modular construction units 12*d,* 12*c* and 12*a,b* assembled laterally or horizontally next to each other. Components shared with other modular construction units 12 from other embodiments are designated with identical reference numbers. If desired, in areas where the modular construction units 12 are secured laterally together, a space 58 is defined, and respective exterior sheathing walls 48 are eliminated. "C"-studs 52 or HSS 44 of adjacent walls are optionally aligned with each other.

Figure 12:
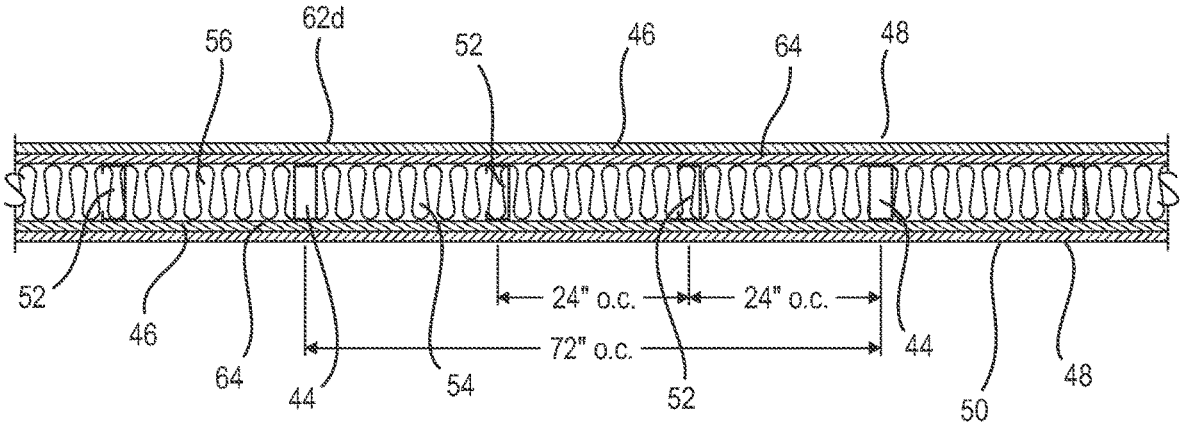
FIG. 12 is a horizontal cross-section of a wall with a 2-hour fire rating of a modular unit constructed according to the embodiment of FIG. 4.
Figure 13:
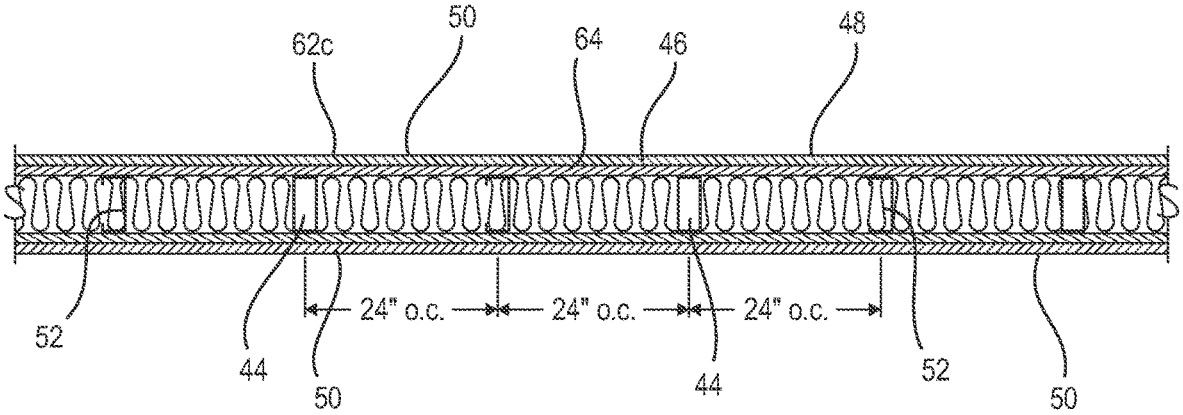
FIG. 13 is a horizontal cross-section of a wall with a 2-hour fire rating of a modular unit constructed according to the embodiment of FIG. 3.
Figure 14:
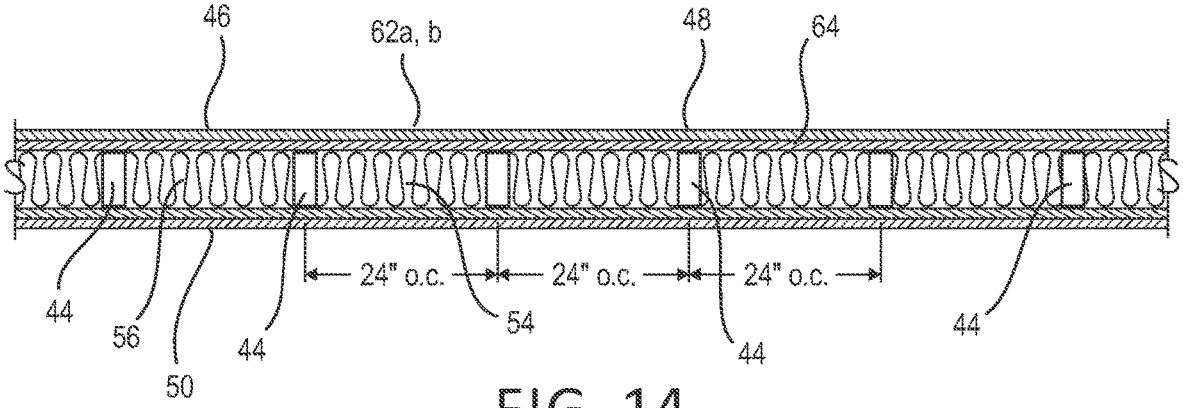
FIG. 14 is a horizontal cross-section of a wall with a 2-hour fire rating of a modular unit constructed according to the embodiment of FIG. 2.

Referring now to FIGS. 12-14, horizontal cross-sections are provided, respectively of modular construction units 62*d,* 62*c* and 62*a,b*. These modular construction units are identical to the modular construction units 12*d,* 12*c* and 12*a,b* with the exception that the sheathing panels 46 are provided in double thickness. In the modular construction units 12*d,* 12*c* and 12*a,b*, the sheathing panels 46 are configured so that both thicknesses are gypsum wallboard, which provides a 2-hour fire rating, or one thickness is gypsum wallboard and the other is structural cement panel 64, which then provides a 3-hour fire rating. When the thicknesses of the sheathing panels 46 are not both gypsum wallboard, the panel facing the interior of the modular construction unit 62*d,* 62*c,* 62*a,b* is preferably gypsum wallboard to facilitate interior decoration of the modular unit.

The structural cement panel 64 used in the double thickness construction discussed above is well known in the art. Suitable panels are described in U.S. Pat. No. 6,986,812; 7,445,738; 7,670,520; 7,789,645 and 8,030,377, all of which are incorporated by reference, and others. Unlike gypsum wallboard panels, structural cement panels 64 often lack face paper coverings. When two thicknesses of sheathing panels 46 are secured to the load bearing frame 14, threaded fasteners are used to directly secure both thicknesses to the HSS 44 and the "C"-studs 52, depending on the particular arrangement as discussed above. It is also contemplated that in some applications, the sheathing panel 46 provided in a single layer is made of structural cement panel 64 instead of gypsum wallboard. A preferred thickness for the structural cement panel 64 is ¾ inch (1.90 cm). However, other thicknesses are contemplated depending on the application. As is known in the art, regardless of the material used, the sheathing panels 46 are commonly provided in 4'×8' (121 cm×243.84 cm) dimensions, however other sizes are contemplated depending on the application.

Figure 15:
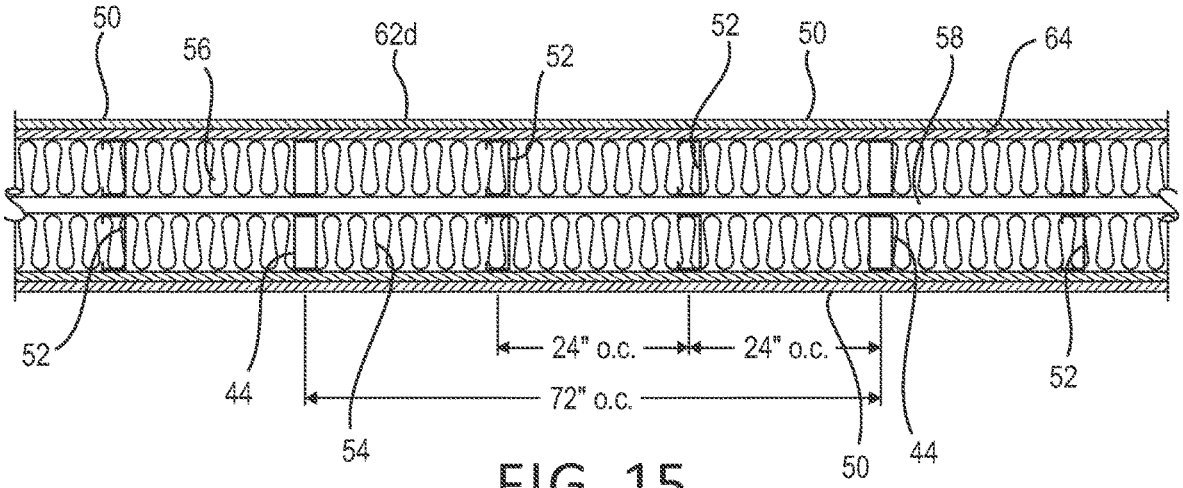
FIG. 15 is a horizontal cross-section of a wall with a 3-hour fire rating of a modular unit constructed according to the embodiment of FIG. 4.
Figure 16:
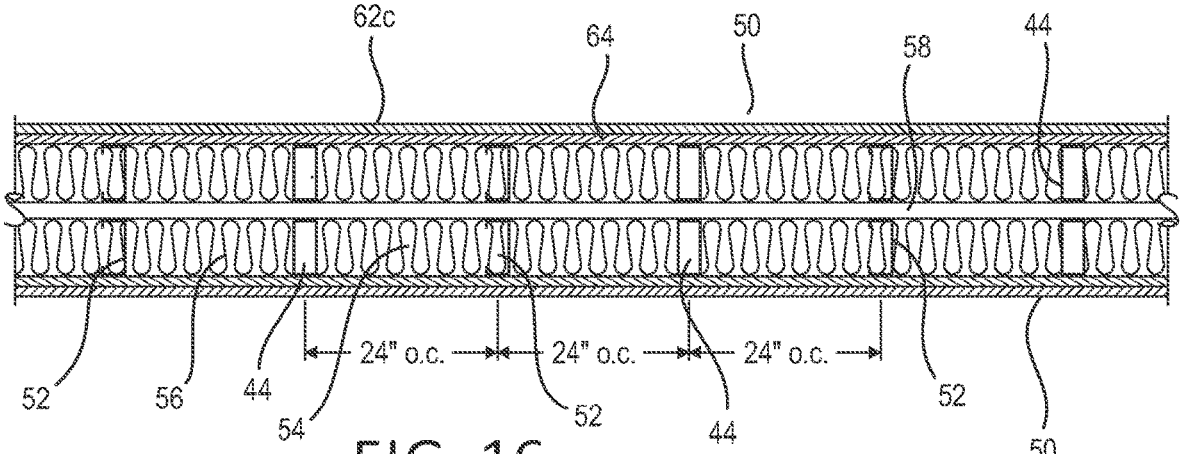
FIG. 16 is a horizontal cross-section of a wall with a 3-hour fire rating of a modular unit constructed according to the embodiment of FIG. 3.
Figure 17:
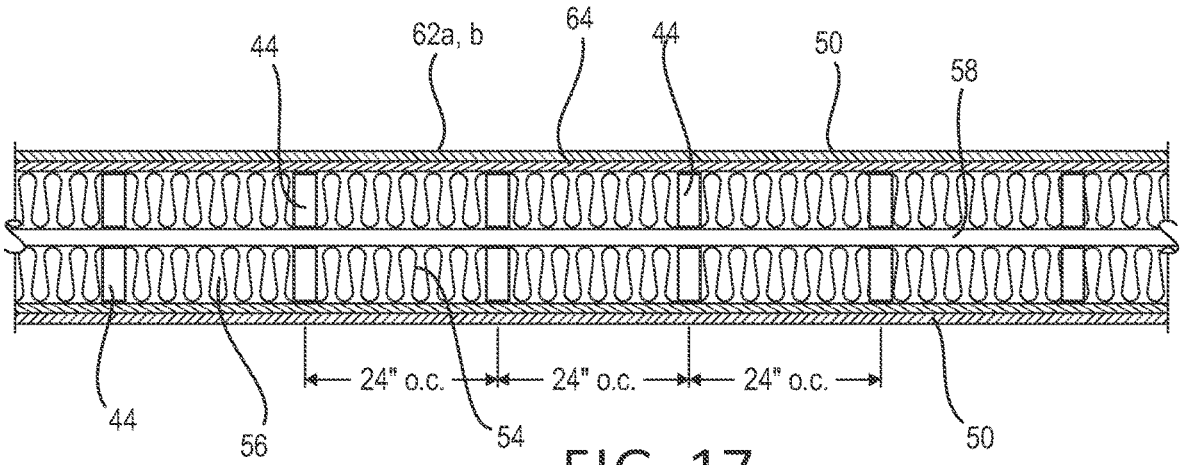
FIG. 17 is a horizontal cross-section of a wall with a 3-hour fire rating of a modular unit constructed according to the embodiment of FIG. 2.

Referring now to FIGS. 15-17, horizontal cross-sections are provided of modular construction units 62*d,* 62*c* and 62*a,b* shown assembled laterally or horizontally next to each other. Components shared with other modular construction units 12, 62 from other embodiments are designated with identical reference numbers. If desired, in areas where the modular construction units 12, 62 are secured laterally together, a space 58 is defined, and respective exterior sheathing walls 48 are eliminated. It is contemplated that the construction illustrated in FIGS. 15-17 will have a 2 or 3-hour fire rating, depending on the material used for the sheathing panels 46 as discussed above. "C"-studs 52 or HSS 44 of adjacent walls are optionally aligned with each other.

While a particular embodiment of the present load bearing wall construction system using hollow structural sections has been described herein, it will be appreciated by those skilled in the art that changes and modifications may be made thereto without departing from the invention in its broader aspects and as set forth in the following claims.

The invention claimed is:

1. A construction unit, comprising:

a load-bearing frame including a plurality of upper horizontal members joined together at ends to form an upper frame portion;

a plurality of lower horizontal members joined together at ends to form a lower frame portion;

a plurality of vertical members joined to and vertically separating said upper frame portion from said lower frame portion, said vertical members being located at opposing corners defined by said upper frame portion and said lower frame portion;

at least one hollow structural section having and load bearing capacity compared to said vertical members and vertically positioned between said upper and lower frame portions and being fixed to said frame between adjacent pairs of said vertical members, each said at least one hollow structural section and each said vertical member having similar depth;

at least one sheathing panel joined directly to said at least one hollow structural section and to said vertical members for forming a wall of said construction unit; and said at least one sheathing panel is made of one of gypsum wallboard and structural cement panel, each thickness of said sheathing panel providing an hour of fire rating due to said direct attachment of said at least one panel to both said vertical members and to said hollow structural panels.

2. The construction unit of claim 1, further including a first plurality of said at least one sheathing panel being structural cement panel directly secured to said at least one hollow structural section forming at least one external wall of said modular unit, and a second plurality of said at least one sheathing panel being gypsum wallboard directly secured to said at least one hollow structural section forming at least one internal wall of said modular unit.

3. The construction unit of claim 1, wherein said at least one sheathing panel is provided in a double thickness, with two panels joined together and attached to said at least one hollow structural section, said double thickness of panels providing a 2-hour fire rating.

4. The construction unit of claim 3, wherein one of said panels joined together is gypsum wallboard forming an inner thickness, and the other is structural cement panel forming an outer thickness.

5. The construction unit of claim 1, wherein said at least one hollow structural section is a plurality of horizontally spaced hollow structural sections secured to said load bearing frame between said adjacent pairs of vertical members.

6. The construction unit of claim 1, further including at least one "C"-stud secured to said load bearing frame adjacent to said at least one hollow structural section so that said at least one sheathing panel is secured directly to both said at least one hollow structural section and to said at least one "C"-stud.

7. The construction unit of claim 6, further including a first plurality of said at least one hollow structural sections, and a second plurality of said at least one "C"-studs secured to said load bearing frame between adjacent pairs of said vertical members in an alternating arrangement.

8. The construction unit of claim 6, further including a first plurality of said at least one hollow structural sections, and a second plurality of said at least one "C"-studs secured to said load bearing frame in a pattern such that between each said pair of said hollow structural sections is a pair of said "C"-studs.

9. A modular construction unit, comprising:

a load-bearing frame including a plurality of upper horizontal members joined together at ends to form an upper frame portion;

a plurality of lower horizontal members joined together at ends to form a lower frame portion;

a plurality of vertical members joined to and vertically separating said upper frame portion from said lower frame portion, said vertical members being located at opposing corners defined by said upper frame portion and said lower frame portion;

at least one hollow structural section vertically positioned between said upper and lower frame portions and being fixed to said frame between adjacent pairs of said vertical members;

a plurality of sheathing panels joined directly to said at least one hollow structural section for forming a wall of said modular construction unit, said plurality of sheathing panels include a first plurality of gypsum wallboard panels and a second plurality of structural cement boards;

said sheathing panels are provided in a double thickness, with two panels joined together and attached to said at least one hollow structural section, one of said panels joined together is gypsum wallboard, and the other is structural cement panel; and at least one "C"-stud secured to said load bearing frame adjacent to said at least one hollow structural section, and each said at least one "C"-stud and each said hollow structural section having a similar depth so that said at least one sheathing panel is secured directly to both said at least one hollow structural section and to said at least one "C"-stud, said double thickness of sheathing panel providing a 2-hour fire rating due to said direct attachment of said panels to both said vertical members and to said hollow structural panels.

10. The modular construction unit of claim 9, further including a first plurality of said at least one hollow structural sections, and a second plurality of said at least one "C"-studs secured to said load bearing frame between adjacent pairs of said vertical members in an alternating arrangement.

11. The modular construction unit of claim 9, further including a first plurality of said at least one hollow structural sections, and a second plurality of said at least one "C"-studs secured to said load bearing frame in a pattern such that between each said pair of said hollow structural sections is a pair of said "C"-studs.

12. A multi-story building comprising:

an assembly of vertically stacked modular construction units, each said modular construction unit comprising:

a load-bearing frame including a plurality of upper horizontal members joined together at ends to form an upper frame portion;

a plurality of lower horizontal members joined together at ends to form a lower frame portion;

a plurality of vertical members joined to and vertically separating said upper frame portion from said lower frame portion, said vertical members being located at opposing corners defined by said upper frame portion and said lower frame portion;

at least one hollow structural section vertically positioned between said upper and lower frame portions and being fixed to said frame between adjacent pairs of said vertical members;

at least one sheathing panel joined directly to said at least one hollow structural section for forming a wall of said modular construction unit, said at least one sheathing panel is made of one of gypsum wallboard and structural cement board; and selected members of said assembly of said modular construction units having at least one "C"-stud secured to said load bearing frame adjacent to said at least one hollow structural section, and each said at least one "C"-stud and each said hollow structural section having a similar depth so that said at least one sheathing panel is secured directly to both said at least one hollow structural section and to said at least one "C"-stud, each thickness of said sheathing panel providing an hour of fire rating due to said direct attachment of said at least one panel to both said vertical members and to said hollow structural panels; and an arrangement of said at least one hollow structural section and said at least one "C"-stud varying in said modular construction units in said assembly such that the amount of said at least one "C"-stud increases relative to said at least one hollow structural section in each said modular construction unit as said respective modular construction unit is placed higher in elevation in said building.

13. The multi-story building of claim 12, further including a first plurality of said at least one hollow structural sections, and a second plurality of said at least one "C"-studs secured to said load bearing frame between adjacent pairs of said vertical members in an alternating arrangement.

14. The multi-story building of claim 12, further including a first plurality of said at least one hollow structural sections, and a second plurality of said at least one "C"-studs secured to said load bearing frame in a pattern such that between each said pair of said hollow structural sections is a pair of said "C"-studs.

* * * * *